US007789142B2

(12) United States Patent
Dotson

(10) Patent No.: US 7,789,142 B2
(45) Date of Patent: Sep. 7, 2010

(54) DOWNHOLE GAS FLOW POWERED DELIQUEFACTION PUMP

(75) Inventor: Bryan D. Dotson, Houston, TX (US)

(73) Assignee: BP Corporation North America Inc., Warrenville, IL (US)

( * ) Notice: Subject to any disclaimer, the term of this patent is extended or adjusted under 35 U.S.C. 154(b) by 0 days.

(21) Appl. No.: 12/221,094

(22) Filed: Jul. 31, 2008

(65) Prior Publication Data

US 2009/0218091 A1 Sep. 3, 2009

Related U.S. Application Data

(60) Provisional application No. 61/067,774, filed on Feb. 29, 2008.

(51) Int. Cl.
*E21B 43/12* (2006.01)

(52) U.S. Cl. ..... 166/250.15; 166/370; 417/40; 417/411

(58) Field of Classification Search ..... 166/370, 166/250.03, 250.15, 150.5, 150, 265; 417/36, 417/40, 423.3, 411
See application file for complete search history.

(56) References Cited

U.S. PATENT DOCUMENTS

| | | | | |
|---|---|---|---|---|
| 4,531,593 | A * | 7/1985 | Elliott et al. | 175/71 |
| 5,517,464 | A | 5/1996 | Lerner et al. | |
| 5,860,795 | A * | 1/1999 | Ridley et al. | 417/403 |
| 6,336,503 | B1 * | 1/2002 | Alhanati et al. | 166/265 |
| 7,396,216 | B2 * | 7/2008 | Blauch et al. | 417/423.3 |

* cited by examiner

*Primary Examiner*—William P Neuder
*Assistant Examiner*—Kipp C Wallace
(74) *Attorney, Agent, or Firm*—Albert K. Shung

(57) ABSTRACT

Methods and systems for removing water from gas wells are described herein. The water is removed by positioning a pump in a liquid layer below the perforations through which gas enters a gas well and powering a water pump with electrical power generated by an energy recovery system which produces electricity from a gas flow through the energy recovery system to an earth surface.

5 Claims, 1 Drawing Sheet

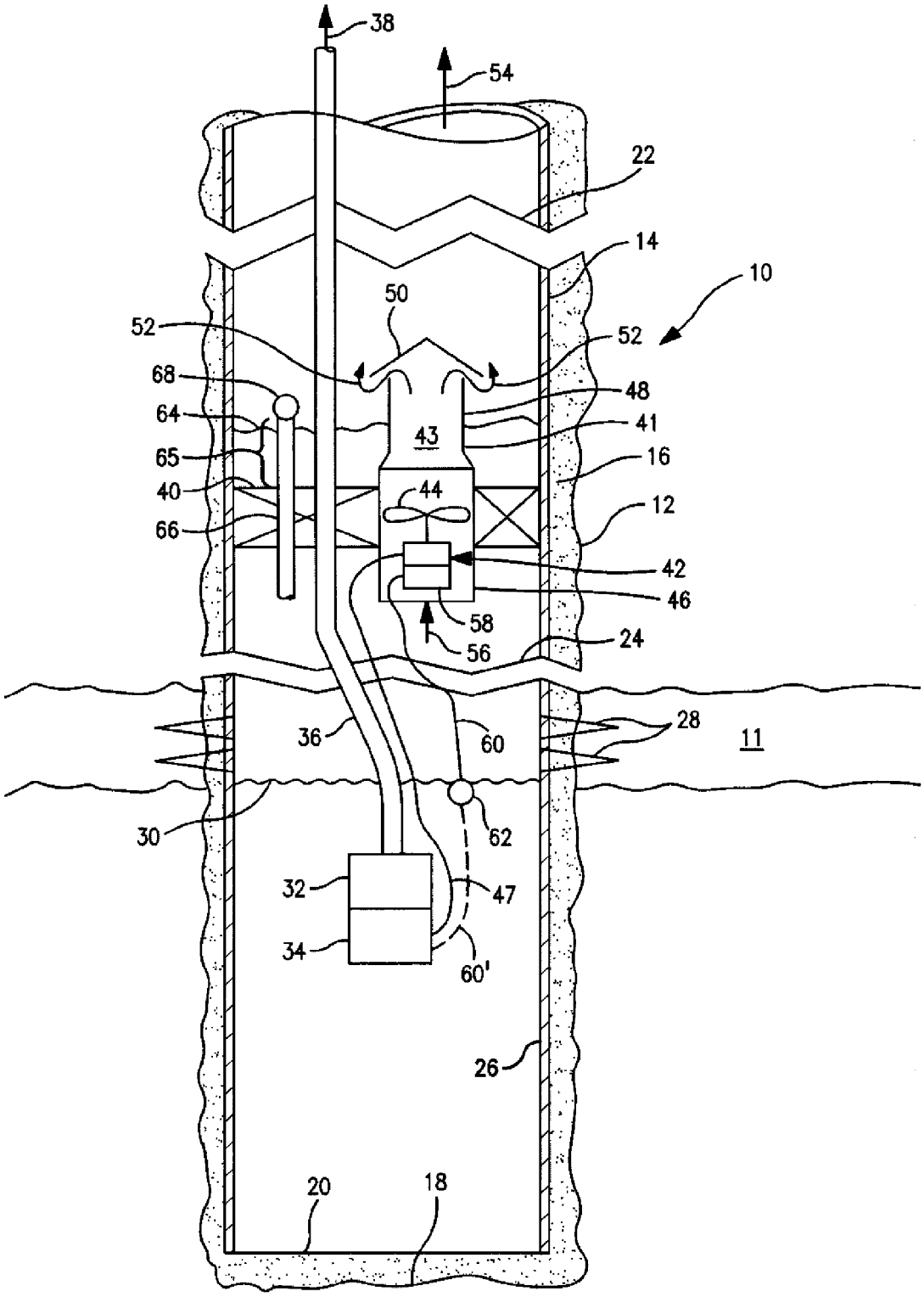
38
54
22
14
10
50
52
52
68
48
64
41
43
65
16
40
44
12
66
42
46
58
56
24
36
60
28
11
30
62
32
47
34
60'
26
20
18

DOWNHOLE GAS FLOW POWERED DELIQUEFACTION PUMP

RELATED APPLICATIONS

This invention is entitled to and hereby claims the benefit of the filing date of U.S. provisional patent application 61/067,774 entitled "Downhole Gas Flow Powered Deliquefaction Pump" filed Feb. 29, 2008 by Bryan D. Dotson.

FIELD OF THE INVENTION

The present invention relates to a method and system for removing water from gas wells. The water is removed by positioning a pump in a liquid layer below the perforations through which gas enters the gas well and powering a liquid pump with electrical power generated by an energy recovery system which produces electricity from a gas flow through the energy recovery system to an earth surface.

BACKGROUND OF THE INVENTION

Many wells which primarily produce gas are also prone to produce liquid in varying quantities with the produced gas. As the gas is produced, the liquid accumulates in the well to a height such that it may well cover the perforations through the well casing into the gas-bearing formation, thereby slowing the production of gas from the well due to the increased hydrostatic head over the outlet from the gas-bearing formation. In some instances the liquid may reach sufficient depths that it substantially stops the production of gas. Such is clearly an undesirable situation. The liquid may be water, oil or mixtures thereof and is referred to herein as "water" or "liquid".

In many instances it has been necessary to position pumps in the well powered by an external source at the surface to remove water from the gas well. This procedure requires additional expense for the installation of the pump and pump motor as well as expense for the electricity required to power the pump and additionally possible expensive maintenance for the pumping equipment. Many such gas wells may be prematurely abandoned due to such expenses when compared to the value of the produced gas.

U.S. Pat. No. 4,531,593 issued Jul. 30, 1985 to Guy R. Elliott, et al (Elliott) and entitled "Substantially Self-Powered Fluid Turbines" discloses a system for a self-powered turbine powered by mixtures of gas and liquid with turbines to produce hydrocarbon gases, water vapor, carbon dioxide, other gases and petroleum from watered out wells and from deep or hot wells. This system uses coaxially shaft-coupled turbines which do not provide the capability to run a pump at a necessary and controlled variable speed.

It would be highly desirable if a system could be developed to pump the water from the gas well with the pumping being powered by a downhole source which does not reply upon imported electricity but relies instead on power produced within the well to drive the pump. A continuing search has been directed to the development of such equipment.

SUMMARY OF THE INVENTION

It has now been found that such gas removal can be readily accomplished by a method for removing liquid from a gas well comprising a wellbore extending from an earth surface to penetrate a subterranean gas-bearing formation and a casing positioned in the wellbore, the casing including perforations to permit gas to flow from the subterranean gas-bearing formation into and inside of the casing, the method consisting essentially of: sealingly positioning a packer in the casing above the perforations to sealingly close an inside of the casing; positioning a pump beneath a first liquid surface below the packer in the casing; producing electrical power with an energy recovery system by passing a gas recovered from the subterranean gas-bearing formation at a pressure greater than a pressure at the earth surface through the energy recovery system; powering the pump with the electrical power and operating the pump at a variable rate to maintain the first liquid surface below a first selected level by pumping liquid via a line through the packer to the earth surface; and, providing a liquid drain through the packer and draining liquid from above the packer to maintain a second liquid surface above the packer at a second selected level.

The invention further comprises a system for removing water from a gas well comprising a wellbore extending from an earth surface to penetrate a subterranean gas-bearing formation and a casing positioned in the wellbore, the casing including perforations to permit gas to flow from the subterranean gas-bearing formation into an inside of the casing, the system comprising: a packer adapted to sealingly close the inside of the casing above the perforations; an energy recovery system including a passageway sealingly positioned through the packer and adapted to produce electrical energy from gas flowing through the passageway; a pump positioned beneath the packer to pump liquid from the casing beneath the packer through a line sealingly positioned through the packer and in fluid communication with a pump outlet and the earth surface; an electrical connector connecting the energy recovery system and an electric motor positioned to drive the pump; a level controller positioned in operative contact with at least one of the energy recovery system and the pump motor to control the pump to maintain a selected liquid level beneath the packer; and, a drain pipe sealingly positioned through the packer, the drain pipe including a drain pipe level controller to control a liquid level above the packer.

BRIEF DESCRIPTION OF THE DRAWINGS

The FIGURE is a schematic diagram of an embodiment of the present invention.

DESCRIPTION OF PREFERRED EMBODIMENTS

In the FIGURE, a well 10 is shown penetrating a subterranean gas-bearing formation 11 which may produce quantities of liquids, such as water, oil, mixtures of water and oil and the like. The oil may be an oleaginous substance which commonly may be referred to as oil. Well 10 comprises a wellbore 12 which includes a casing 14 cemented in place with cement 16. The well extends to a bottom 18 of wellbore 12 with the bottom 20 of the casing positioned slightly above bottom 18. Broken sections 22 and 24 indicate that the well is not to scale, especially with respect to length.

Perforations 28 are positioned to provide fluid communication between gas-bearing formation 11 and an inside 26 of casing 14. As shown, liquid has accumulated in well 10 to a level 30 beneath perforations 28 and a packer 40 which is positioned to sealingly shut-off the inside of casing 14 as shown. A pump 32 is positioned beneath liquid level 30 although pump 32 could be positioned at any level from which suction could be had from the liquid below level 30. The liquid may be water, brine, crude oil or any other oleaginous fluid. These fluids may be present in any mixture and are equally problematic no matter in what proportions they are mixed. Covering the perforations with fluid is detrimental to the continued production of natural gas from gas-bearing formation 11. The liquid is pumped by pump 32 powered by a motor 34 through a line 36 to a discharge at the surface as shown by arrow 38. Line 36 is sealingly positioned through packer 40.

An energy recovery system 41 is shown and includes a passageway 43 through packer 40. The energy recovery system comprises a generator 42 driven by a fan, turbine, or the like 44. The fan 44 is housed in a housing 46 which also houses a control system 58 connected with a level control sensor 62 via a line 60. The level control sensor 62 is adapted to control the level 30 by adjusting the speed of pump 32 by varying the power to pump motor 34 or shutting motor 34 off if required. The control sensor 62 may also be used to adjust the amount of electricity produced by generator 42 by bypassing a portion of the gas passed to fan 44 and upward through passageway 43 to discharge as shown by arrows 52 and 54 upwardly through the inside 22 of casing 14. A cap 50 is positioned over the top of passageway 43 to prevent liquids, debris and the like from falling into passageway 43. An exhaust passageway 48 is formed to provide a greater length of passageway 43 to facilitate the passage of gas through energy recovery system 41.

This added height to the energy recovery system enables the maintenance of a liquid layer surface 64 above packer 40. A drain pipe 66 is sealingly positioned through packer 40 and serves to drain liquid from the liquid layer above packer 40. It is desirable that a liquid layer be maintained so that gas does not pass through drain pipe 66 rather than through passageway 43. The liquid level is desirably maintained at a height shown at 65 by the use of a level controller 68. Drain pipe 66 may comprise simply a one-way valve positioned at a lower end of drain pipe 65 to permit liquid to flow under sufficient pressure to maintain the desired hydrostatic head 65 above packer 40. Other types of flow controller can be used since a variety of controllers are known to control the depth of a liquid level in a zone controlled by a drain pipe. This results in returning liquid which may be condensed, entrained or otherwise escaped from the area below packer 40 back to the liquid level maintained by pump 32 and motor 34. Similarly the energy recovery system is sealingly positioned through packer 40.

In the practice of the invention, gas is produced through perforations 28 and liquid level 30 will tend to increase if liquid is produced at a rate high enough to threaten to cover one or more of the perforations without controlled removal. In this instance, the gas which is typically at a pressure greater than the pressure at the earth's surface, will be produced and passed upwardly through energy recovery system 41 thereby generating electrical power which can be used to power pump 32 and motor 34 to pump the excess liquid from well 10.

When liquid surface 30 has dropped to a desired level, motor 34 may be either shut-off or motor 34 may be reduced to a lesser speed or the like to control the level of liquid in well 10. This achieved by controllers (not shown) included in controller 58 and motor 34 which are controllable and responsive to level sensor 62. The liquid level is thus maintained within a defined range by the use of electricity generated downhole so that the well may be produced with no surface power, pumps or the like.

The apparatus of the present invention is readily installed by simply assembling the apparatus at the surface and passing it into the well using line 36 to support the assembly for installation at a desired level above perforations 28 so that the pump and motor apparatus are positioned at a suitable distance beneath energy recovery system 41. The system then operates unattended to effectively enable the efficient production of gas from a gas well with continued removal of liquids as required.

The items of equipment needed to construct the apparatus of the present invention are well known and individually available. For instance, the fan 44 may be a turbine, a fan, an axial system or the like. The system is effective to recover energy from the flowing gas stream, as well known to those in the art. This enables the operation of a generator 42 controlled by a controller 58. The generator may be disengaged partly or entirely to provide either a shut-off or a reduced electric current which will result in a reduced speed at motor 34. The system is self-controlling based upon the level of liquid in well 10. The generator may be a centrifugal or axial turbine, sliding vane progressing cavities or the like generator. On such generator which could be adapted to this service is the GT-400 generator, available from Natural Gas Turbine Technologies, Inc.

The controls to engage and disengage the generator are considered to be well-known as is the level sensor and the controls to control the speed of motor 34 based upon variations in current. The pump may be a centrifugal pump, a progressing cavity pump, a diaphragm pump, a plunger pump or the like. Such pumps are known for such applications. Similarly, the motor is of a well-known type which can be used to drive any of the types of pumps.

The combination of these materials results in a self-regulating system which can operate solely with the energy produced by the gas pressure to maintain a selected liquid level in a gas well. This is a significant improvement in the art and results in the production of natural gas from subterranean formations which also produce liquid at a greatly reduced cost with greatly reduced expense for maintenance, equipment, power and the like.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for removing liquid from a gas well comprising a wellbore extending from an earth surface to penetrate a subterranean gas-bearing formation and a casing positioned in the wellbore, the casing including perforations to permit gas to flow from the subterranean gas-bearing formation into an inside of the casing, the method consisting essentially of:

a) sealingly positioning a packer in the casing above the perforations to sealingly close an inside of the casing;

b) positioning a pump beneath a first liquid surface below the packer in the casing;

c) producing electrical power with an energy recovery system by passing a gas recovered from the subterranean gas-bearing formation at a pressure greater than a pressure at the earth surface through the energy recovery system;

d) powering the pump with the electrical power and operating the pump at a variable rate to maintain the first liquid surface below a first selected level by pumping liquid via a line through the packer to the earth surface; and, e) providing a liquid drain through the packer and draining liquid from above the packer to maintain a second liquid surface above the packer at a second selected level, wherein the second selected level is maintained at a depth above the packer to provide a hydrostatic head pressure in the liquid drain greater than a gas pressure drop through the energy recovery system.

2. The method of claim 1 wherein the perforations are positioned above the first selected level.

3. The method of claim 1 wherein the liquid is an aqueous liquid.

4. The method of claim 1 wherein the liquid is an oleaginous liquid.

5. The method of claim 1 wherein the liquid pumped by the pump comprises both an aqueous liquid and an oleaginous liquid.

* * * * *